United States Patent [19]

Field

[11] Patent Number: 4,955,224

[45] Date of Patent: Sep. 11, 1990

[54] ADJUSTABLE HEIGHT VEHICLE FRAME STRAIGHTENING APPARATUS

[75] Inventor: Carl R. Field, Treasure Island, Fla.

[73] Assignee: Duz Mor, Inc., Des Moines, Iowa

[21] Appl. No.: 379,334

[22] Filed: Jul. 13, 1989

[51] Int. Cl.[5] ..... B21D 1/12

[52] U.S. Cl. ..... 72/457; 72/705

[58] Field of Search ..... 72/457, 705

[56] References Cited

U.S. PATENT DOCUMENTS

| | | | |
|---|---|---|---|
| 3,269,169 | 8/1966 | Latuff et al. . | |
| 3,377,834 | 4/1968 | Latuff et al. . | |
| 4,138,876 | 2/1979 | Chisum | 72/705 |
| 4,353,241 | 10/1982 | Field . | |
| 4,546,638 | 10/1985 | Field . | |
| 4,574,614 | 3/1986 | Field . | |

OTHER PUBLICATIONS

Copy of five page brochure entitled Marquette CDS/360.

Copy of 10-page brochure entitled Marquette Frame System.

Color 4-page brochure entitled Duzmor Inc. Truck Collision Repair System.

Copy of 3-page brochure entitled Duz-Mor—Wow! Nobody can pull the kinds out of my trunk . . . er, truck like a DUZ-MOR.

*Primary Examiner*—Lowell A. Larson

*Attorney, Agent, or Firm*—Henderson & Sturm

[57] ABSTRACT

A vehicle repair and straightening apparatus, including a lower framework forming a cage for receiving a damaged vehicle. Structure is provided for restraining the damaged vehicle within the lower framework and a tower structure is movably attached to the lower framework for applying a force on a portion of the damaged vehicle. An upper framework is movably attached to the lower framework and structure is provided for permitting the upper framework to be selectively movable with respect to the lower framework between a lowered transport position and a raised working position. A tower structure attached to the apparatus has hydraulics associated therewith for pulling damage from a damaged vehicle but this structure is also useful to selectively move the upper framework between the transport position and the raised position thereof.

5 Claims, 6 Drawing Sheets

ADJUSTABLE HEIGHT VEHICLE FRAME STRAIGHTENING APPARATUS

TECHNICAL FIELD

The present invention relates generally to an apparatus for repairing and straightening vehicles, and more particularly to such a device having a cage structure with a telescoping top to enable it to be lowered for transportation down the highway and through low entry doorways and body shops and then to be raised once inside such body shops so it will accommodate larger, higher vehicles, such as trucks.

BACKGROUND ART

There are many machines manufactured for straightening automobiles and small trucks which are small enough to be transported from place to place on public highways. U.S. Pat. No. 4,754,614 to Field shows just such a machine. The machines needed to repair larger trucks obviously need to be larger and stronger than those utilized for cars and smaller trucks. U.S. Pat. No. 4,353,241 to Field shows an example of such larger truck repairing and straightening machine. While such machine is an excellent piece of equipment, it does require that a pit be built and that the machine be built over the pit rather than to merely transport the machine over the public highways to its ultimate destination. It would be too high to provide adequate clearance in situations where secondary roads or other highways pass over an interstate, for example. If this device were to be made shorter, then it would not be useful for many larger and higher trucks.

Another problem with transporting a truck machine of the aforementioned type to a location within a body shop is that the body shop doors are typically not high enough to provide adequate clearance to allow such machine in a fully assembled state to pass through such entrance doorways.

Consequently, there is a need for a portable truck machine which will overcome the aforementioned problems.

DISCLOSURE OF THE INVENTION

The present invention relates generally to a vehicle repair and straightening apparatus including a lower framework forming a cage for receiving a damaged vehicle. Structure is provided for restraining the damaged vehicle within the lower framework and a tower structure is movably attached to the lower framework for applying a force on a portion of the damaged vehicle. An upper framework is movably attached to the lower framework and structure is provided for permitting the upper framework to be selectively movable with respect to the lower framework between a lowered transport position and a raised working position. A tower structure attached to the apparatus has hydraulics associated therewith for pulling damage from a damaged vehicle but this structure is also useful to selectively move the upper framework between the transport position and the raised position thereof.

An object of the present invention is to provide an improved vehicle repair and straightening apparatus.

Another object of the present invention is to provide a machine of the aforementioned type which has a large enough cage structure to accommodate large trucks but which can be collapsed to be small enough to legally travel on public highways or to pass through low doors in body shops.

Other objects, advantages, and novel features of the present invention will become apparent from the following detailed description of the invention when considered in conjunction with the accompanying drawings.

BEST MODE FOR CARRYING OUT THE INVENTION

Figure 1:
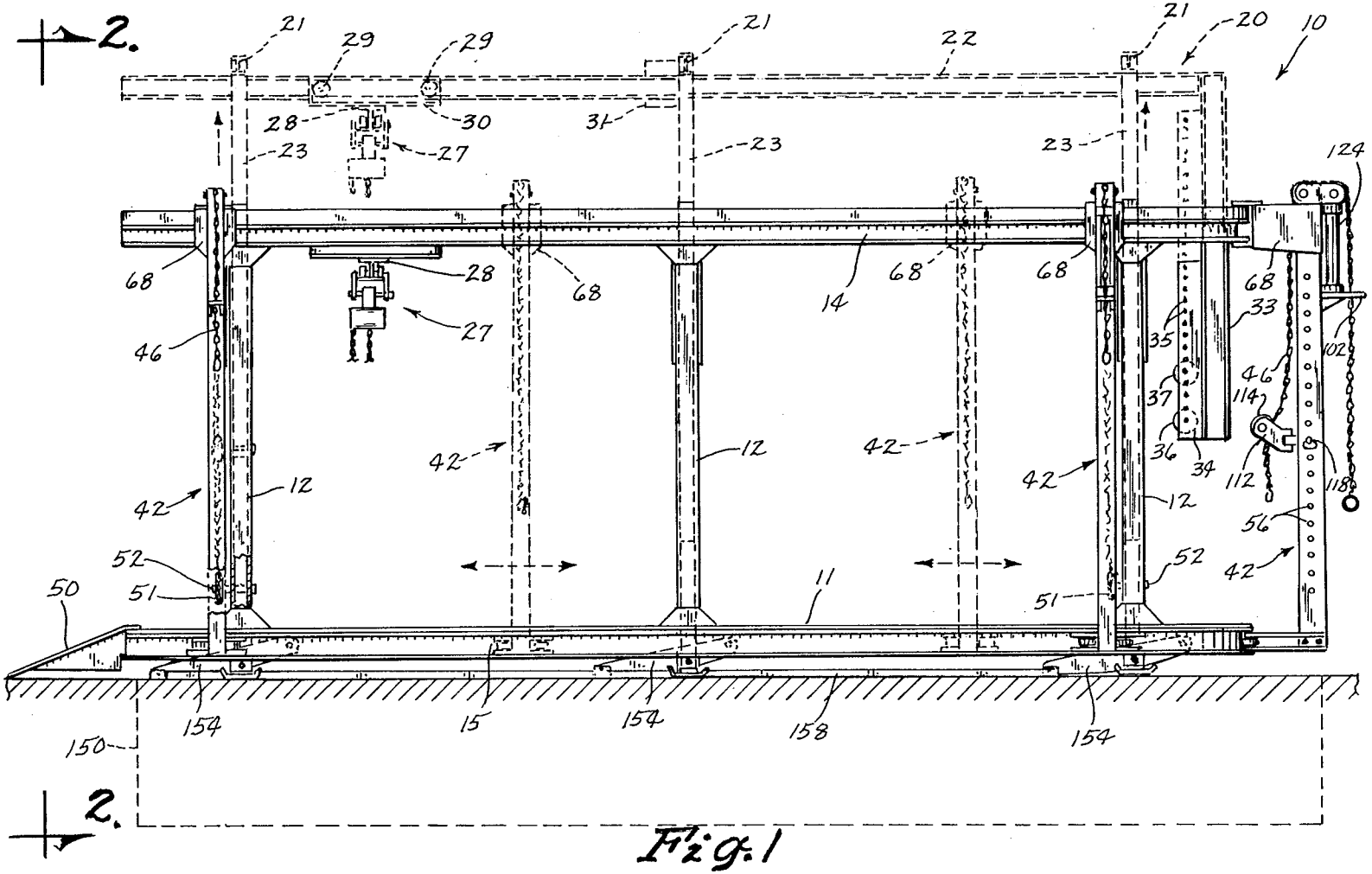
FIG. 1 is a side elevational view of a preferred embodiment of the present invention showing in solid lines the preferred embodiment in a transport position and showing in dashed lines the operating position of the present invention; also shown in dashed lines is how it can be placed over a pit rather than using the lift mechanism shown therein.

Referring now to the drawings wherein like reference numerals designate identical or corresponding parts throughout the several views, FIG. 1 shows a vehicle repair and straightening apparatus (10) constructed in accordance with the present invention.

The apparatus (10) includes a vehicle supporting surface (11) for supporting the wheels of trucks to be disposed thereon and a cage structure including upwardly extending members (12) which are connected at the bottom thereof to the vehicle support (11) and at the top thereof to an upper tower support including a horseshoe shaped track (14). A lower horseshoe shaped track (15) is attached around the edge of the vehicle supporting surface (11) and forms a portion of the vehicle support (11).

Longitudinally extending I-beams (16) are welded to transversely extending I-beams (17) and these transversely extending I-beams (17) are welded to the track (15) so that the vehicle support is very rigidly attached in one assembly and has the vehicle support plates (11) disposed thereon and connected thereto. A plurality of openings (18) are disposed in each of the plates (11) so that chains or other tie-down type devices can be connected to the plates (11) to hold down trucks which are disposed on the vehicle support plates (11).

The towers (42) are substantially identical to the towers shown in U.S. Pat. No. 4,574,614, which patent is incorporated herein by reference. These towers (42) have a roller (84) attached through a bracket (82) on the bottom thereof for rolling around the track (15). Top brackets (68) have rollers (72) attached thereto which extend over an upwardly extending flange (74) which is attached to the upper track (14) so that the tower (42) can be readily moved around to virtually any place on the upper and lower tracks (14) and (15). For example, these towers (42) can be moved from the positions shown in solid lines to the positions shown in dashed lines in FIG. 1 and to any position in between those positions shown. Chains (46) pass over upper pulleys (94) and a hydraulic cylinder (124) moves a chain engaging bracket (102) between the extreme upper position shown in solid lines in FIG. 2 and the extreme lower position shown in dashed lines in FIG. 2. Brackets (112) can be pinned by pin (118) to any one of the holes (56) in the tower (42) so that the chain (46) can wrap around pulley or shim (114) and pull at virtually any height on a portion of a vehicle disposed on the vehicle supporting plates (11). It will be understood, of course, to those skilled in this art, that other types of towers can be utilized in this invention; for example the two tower designs shown in U.S. Pat. No. 4,546,638 to Field show other possible tower designs which can be utilized.

An upper framework (20) has a plurality of transverse I-beams (21) and longitudinal beams (22) welded thereto. Vertical posts (23) have a plurality of holes (24) disposed therein for reasons which will be explained below. Brackets (25) are welded to the upstanding posts (12) and have a plurality of openings (26) disposed therein. A hoist (27) is operatively attached to a beam (28) in the same general way that the hoist of U.S. Pat. No. 4,574,614 is shown attached in FIG. 20 of that patent. Transverse beam (28) rides on double rollers (29) to allow it to move forward and back on the lower horizontal flanges of I-beams (22). Brackets (30) have the rollers (29) rotatably attached thereto and these brackets (30) are also rigidly attached to the movable cross beam (28). A central control box (31) has hydraulic lines (not shown) attached thereto.

The front of the upper framework (20) has a pair of I-beams (33) welded thereto and each of these I-beams (33) has a pair of flanges (34) having holes (35) disposed therein. A pulley or shim (36) is pinned to the bottom-most opening (35) as is shown in more detail in FIG. 9.

Figure 2:
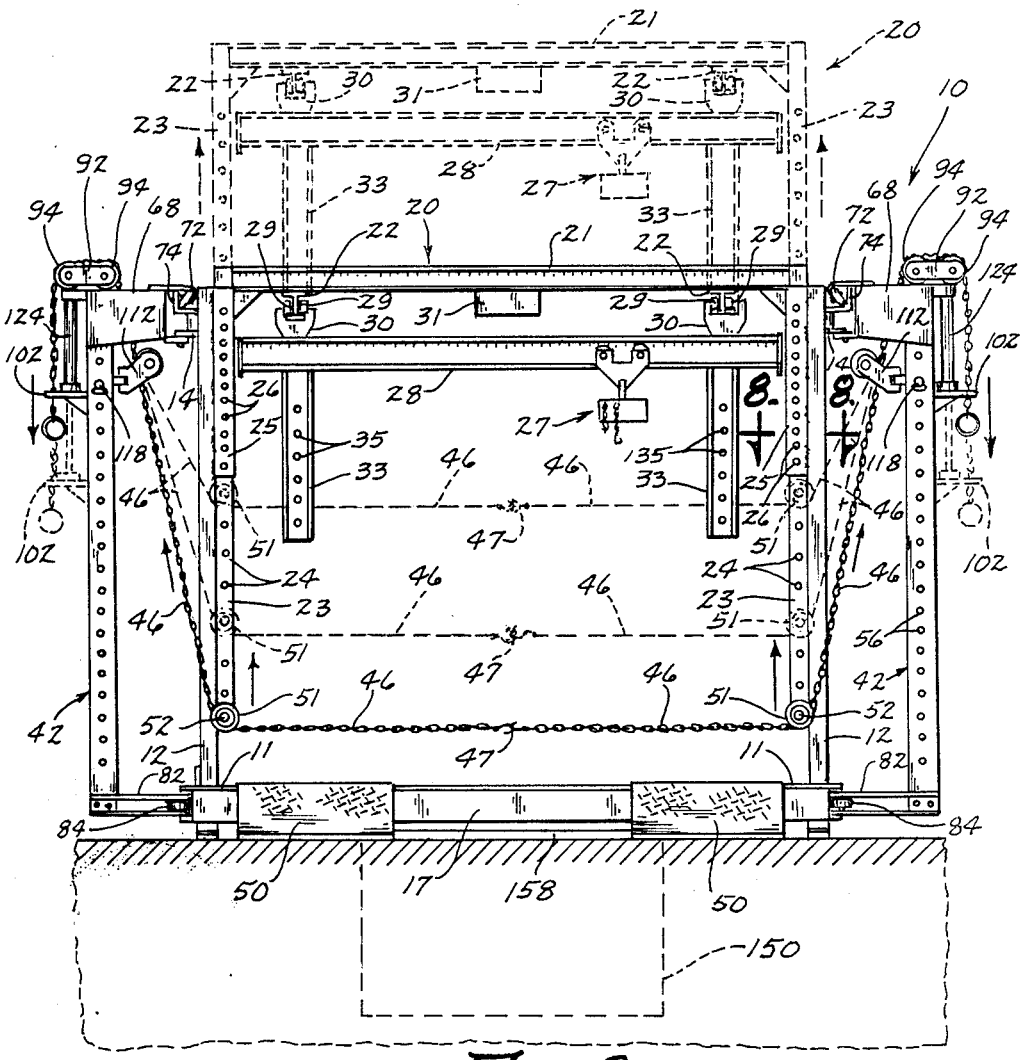
FIG. 2 is an end view taken along line 2—2 of FIG. 1; also shown is the preferred embodiment in solid lines in a transport position and in dashed lines is shown how the tower hydraulic mechanism is used to lift the upper framework into the working position thereof.
Figure 3:
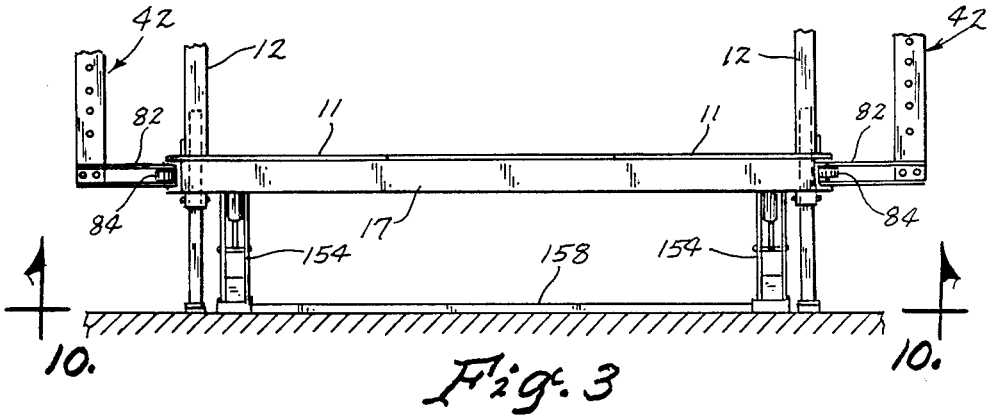
FIG. 3 is a view similar to FIG. 2 but showing the ramps removed and the device raised by use of the optional lift mechanism.

The lift structure, including lower floor engaging member (150) and lever arms (154), are essentially identical in configuration and function to the lift structure shown in FIGS. 2 and 3 of U.S. Pat. No. 4,574,614 except that, of course, there are three pairs of lift arms (154) shown in the present invention and these lift arms (154) will naturally be larger and stronger because the machine apparatus (10) is larger than the machine shown in U.S. Pat. No. 4,574,614.

Figure 5:
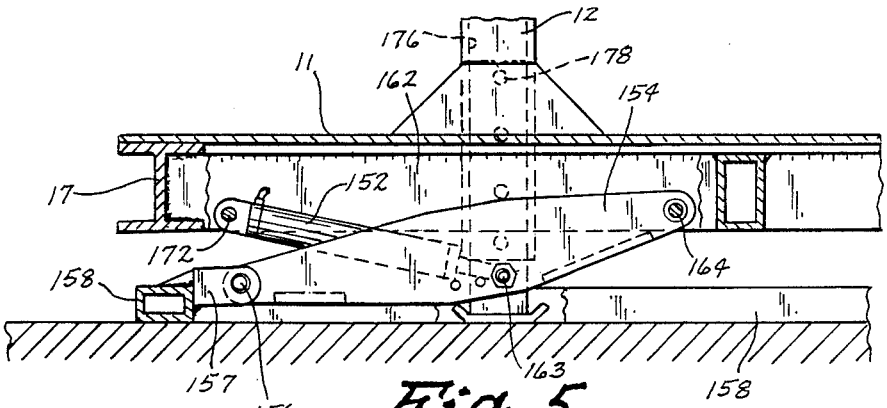
FIG. 5 is a cross sectional view taken along line 5—5 of FIG. 4 showing the lift mechanism in the lowered position thereof.
Figure 6:
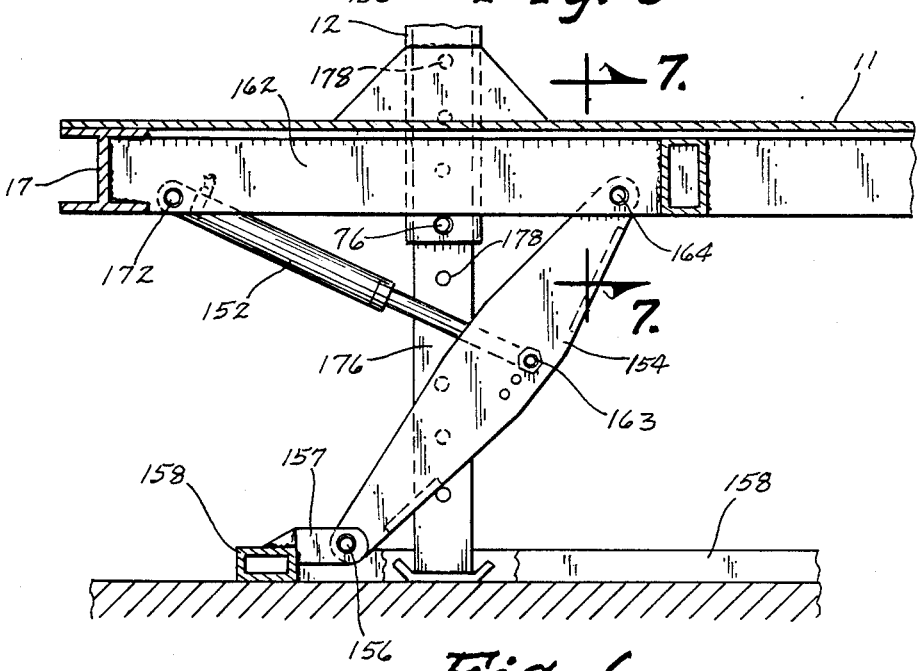
FIG. 6 is a view like FIG. 5 but showing the vehicle supporting platform raised by use of a lifting mechanism.
Figure 7:
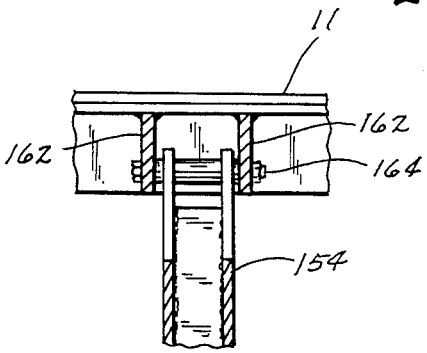
FIG. 7 is an enlarged partial cross sectional view taken along line 7—7 of FIG. 6.
Figure 8:
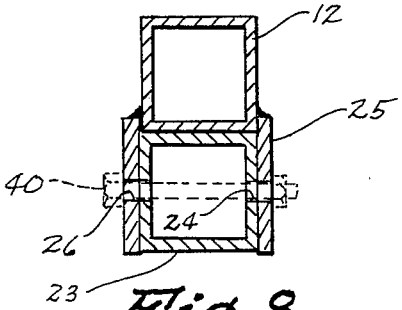
FIG. 8 is an enlarged partial cross sectional view taken along line 8—8 of FIG. 2.

Referring to FIGS. 5 and 6, it is noted that the arms (154) are pivotally attached by a pin structure (164) to the beams (162). The other end of the arm (154) is pivotally attached by a pin (156) to a bracket (157) welded to member (158), which is in turn welded to the floor engaging member (150).

A hydraulic cylinder (152) is pivotally attached at one end by pin (172) to the beam (162) and by pin or bolt (163) at the other end of the hydraulic cylinder (152) to a central portion of the arm (154). Each of the lift arms (154) is essentially identical and has an identical hydraulic cylinder (152) attached thereto.

A safety leg (176) is slidably disposed in the vertical post (12) and openings (178) in the safety leg (176) can be aligned with openings (76) in the upwardly extending members (12) so that once the vehicle supporting members (11) are at the height desired, a pin, (not shown) can be extended through aligned holes (76) and (176) to relieve the pressure exerted on hydraulic cylinders (152).

In operation, the apparatus (10) shown in FIG. 1 can be of a configuration having a lift thereunder or the lift, including lift arms (154), can be omitted if it is to be placed over a pit such as pit (150) shown in dashed lines in FIGS. 1 and 2. To transport the apparatus (10) from place to place, the hoist (27) is essentially chained down and the towers (42) are secured in position so they will not roll during the transportation phase. Also, the upper framework (20) is in the lowered position as shown in solid lines in FIGS. 1 and 2. Ramps (50) are removable and would merely be taken along for installation in the body shop later. Once the apparatus (10) is loaded on a trailer, it can then be transported down the highway without fear of it being too high to pass under bridges or other overhead obstructions. When it arrives at the body shop where it is to be installed, it can readily be towed or pushed through the door of most body shops in the lowered position shown in FIGS. 1 and 2.

Once inside the body shop where it is to be used, the arrangement of the chains (46) shown in FIG. 2 is made wherein the hooks (47) at the ends thereof are hooked together and a pulley (51) is pinned by pin (52) into the bottom of four of the vertical members (23). The towers (42) are placed across from each other in pairs, one near the front of the machine, adjacent to one pair of the vertical members (23) and the other towers (42) are positioned towards the back, adjacent to the rearmost pair of vertical members (23).

Once all four pulleys (52) are in place and all four chains (46) are connected together in pairs as shown in FIG. 2, the hydraulic cylinders (124) are actuated to move from the position shown in solid lines to the position shown in dashed lines in FIG. 2. This will cause the upper framework (20) to move from the position shown in solid lines in FIG. 2 to the position shown in dashed lines in FIG. 2. Once this upper framework is in the upper position shown in FIG. 2, it can then be pinned by placing a pin (not shown) through aligned holes (26) in the brackets (25) and holes (24) in vertical members (23). This will hold the upper framework in the desired position so that large trucks can be worked on and have adequate clearance.

The ramps (50) can be used when loading and unloading damaged vehicles thereon and these ramps (50) can be left in place if the machine (10) is to be used over a pit (150), However, if the lift structure, including lift arms (154) are utilized, then typically the ramps (50) are left in place only during the loading process and are removed while the vehicle is being repaired.

It will be appreciated that the upper framework (20) can be raised to an extreme upper height depending upon the design of the device or if it happens that the particular body shop into which it is installed will not permit the upper framework (24) to go to its extreme upper position, then it can be pinned at a lower height which would typically be as high as the ceiling would permit in such body shop.

Figure 9:
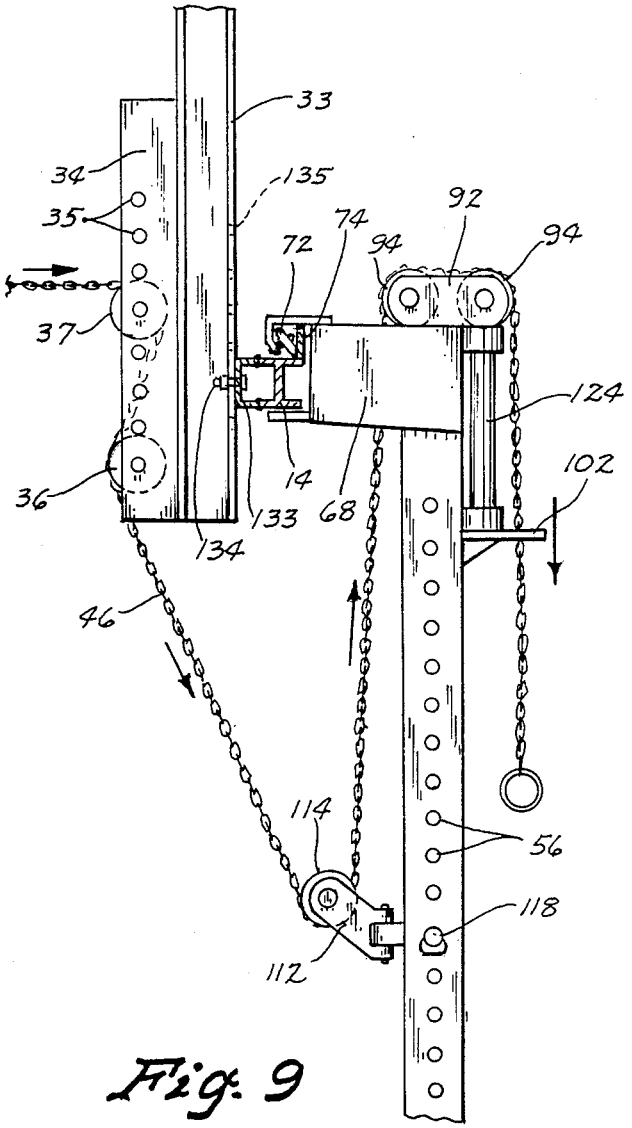
FIG. 9 is an enlarged partial view of the right side of FIG. 2 showing how to pull on an upper portion of a truck using the present.
Figure 10:
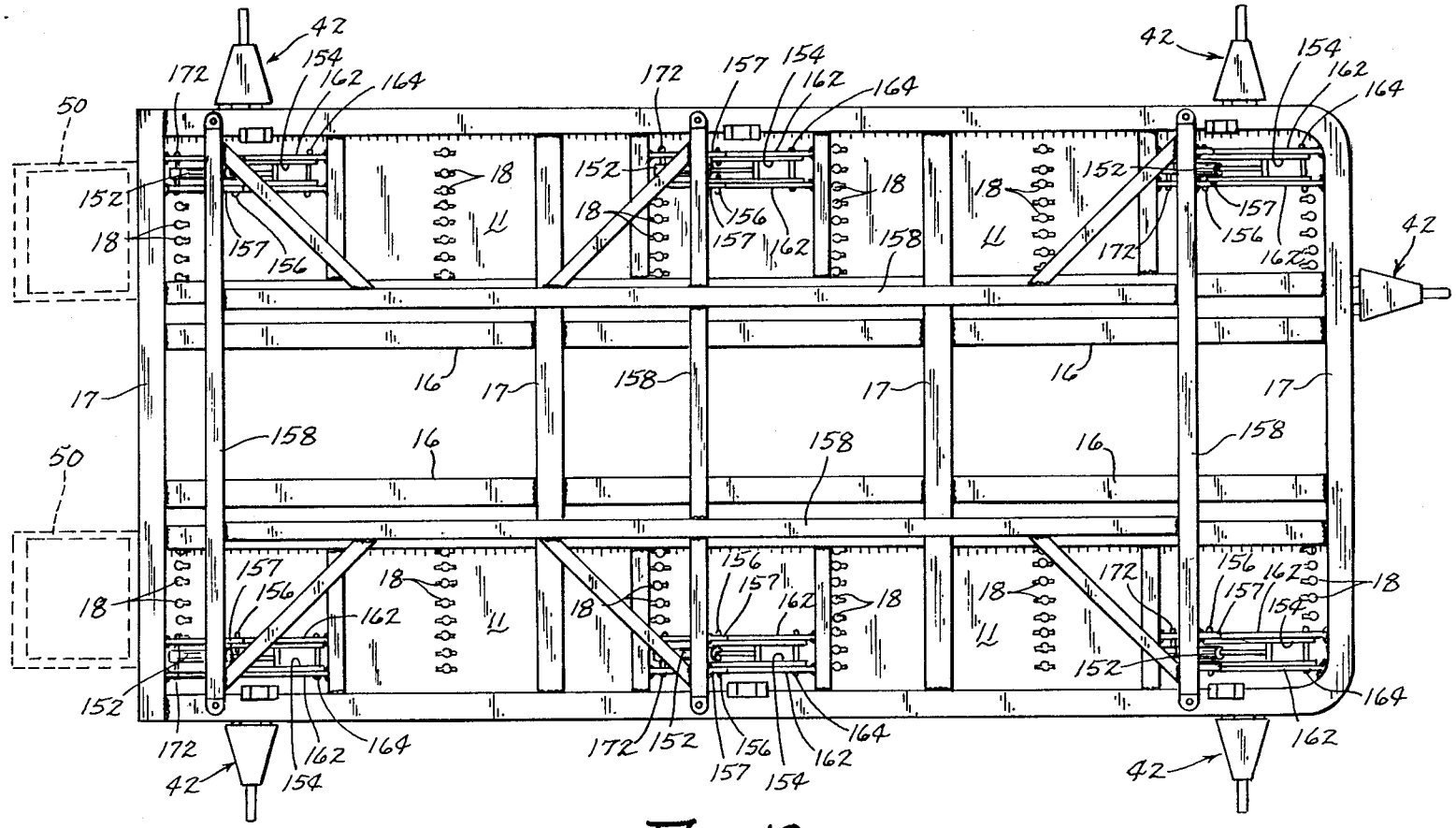
FIG. 10 is a bottom plan view of the present invention.

Another aspect of the invention is that, as shown in FIGS. 1, 2 and 9, when the vertical I-beams (33) are raised, the vertical I-beam is then bolted to a bracket (133) which is welded to the front of the U-shaped upper track (14). A nut and bolt assembly (134) extends through an opening in the bracket (133) and through openings (135) in the beam (33) to firmly hold the vertical beam (33) in place. A pair of brackets (34) are welded in spaced relationship on each of the vertical beams (33) so that pulleys (36) and (37) can be pinned thereon.

Once both of these vertical members (33) are bolted in place as shown in FIG. 9, the tower can be utilized to pull damage on an upper portion of a truck by threading the chain (46) around the pulley (36) and around and over the pulley (37), thereby creating an outward pull on the truck and a downward pull on the chain as shown in FIG. 9. It will be understood to those skilled in the art that the pulley (37) can be positioned up or down and placed into any one of the openings (35) in the flanges (36) so that pulls can be made at such different heights.

If, at a later date, it is desired to move the apparatus (10) to a different location, the reverse procedures can be utilized to lower the upper framework, transport the device over public highways and through body shop door openings where the apparatus (10) can again be raised to the upper position of the upper framework (20) as shown in dashed lines in FIGS. 1 and 2.

Figure 4:
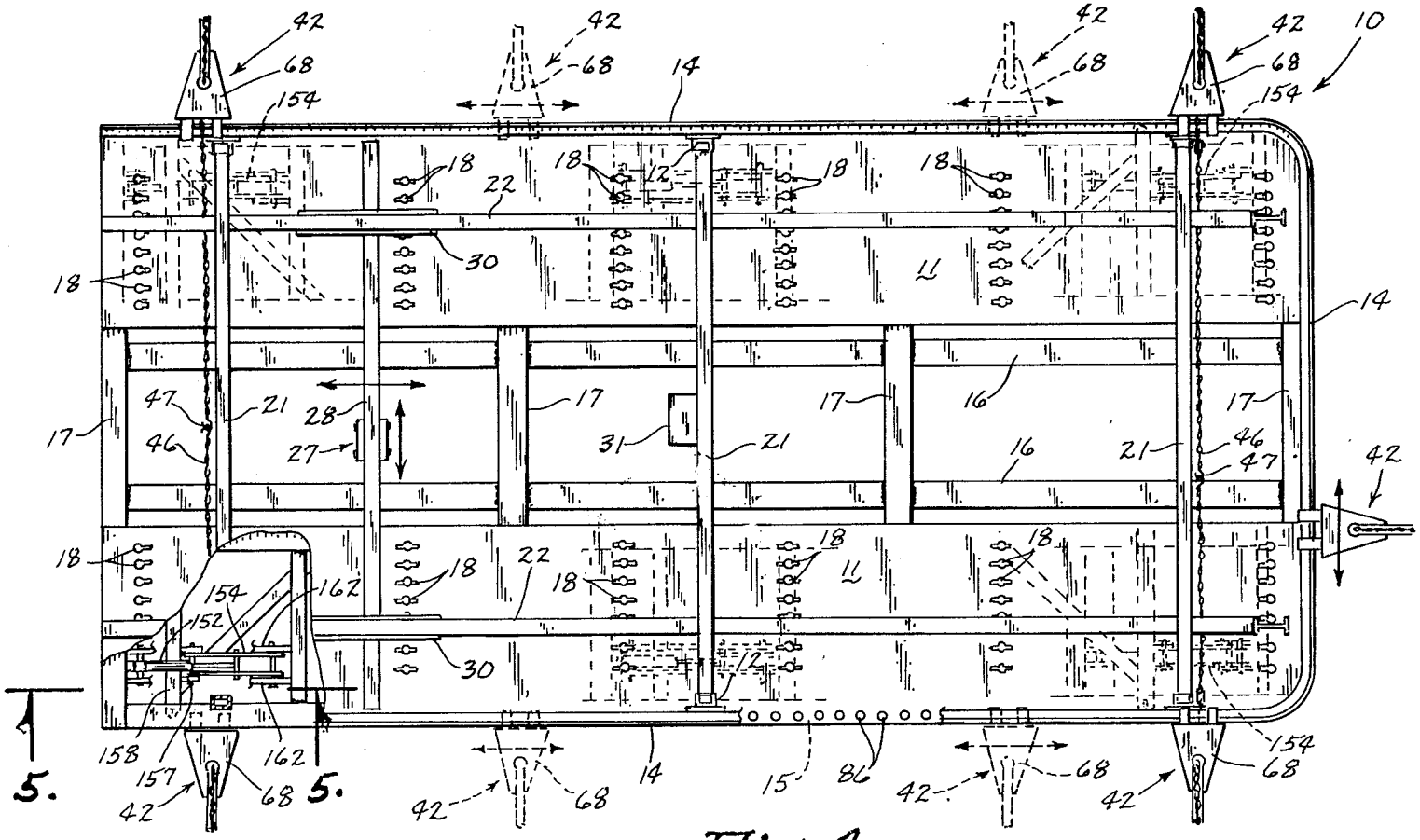
FIG. 4 is a top plan view of the present invention showing a portion thereof broken away to expose a portion of the lift mechanism.

Referring to FIG. 4, it is noted that a portion thereof is broken away to show a plurality of openings (86) which are disposed in the entire outside periphery of each of the plates (11) so that, if desired, a pin (88) can extend therethrough and through the plate (82) in the bottom of each of the towers (42) to hold the tower (42) in place. This normally is not necessary except at the corners but it can be utilized nonetheless, if desired.

Accordingly, it will be appreciated that the preferred embodiment shown herein does indeed accomplish the aforementioned objects. Obviously, many modifications and variations of the present invention are possible in light of the above teachings. It is therefore to be understood that, within the scope of the appended claims, the invention may be practiced otherwise than as specifically described.

I claim:

1. Vehicle repair apparatus comprising:

vehicle supporting means for supporting the wheels of a vehicle to be repaired;

at least one tower means for pulling on parts of a vehicle disposed on said vehicle supporting means, said tower means having an upper end and a lower end;

a lower tower support disposed around a portion of said vehicle supporting means;

an upper tower support disposed upwardly from said vehicle supporting means and at approximately the same height as the upper end of said tower means;

upwardly extending members rigidly attached at the bottom thereof to said vehicle supporting means and at the top thereof to said upper tower support;

means for selectively attaching the upper end of said tower means to said upper tower support;

means for permitting said upper end of said tower means to move in a horizontal direction with respect to said upper tower support;

means attached to the lower end of said tower means and engaging said lower support for permitting said lower end of said tower means to move horizontally with respect to said lower tower support;

an upper framework;

downwardly extending members operably connected to said upper framework, said downwardly extending members being disposed in a sliding relationship with said upwardly extending members for permitting said upper framework to be lowered for transporting said vehicle repair apparatus from place to place; and means associated with said downwardly extending members for holding said upper framework in an upper working position so as to provide adequate clearance for relatively high vehicles to be disposed on said vehicle supporting means.

2. The vehicle repair apparatus of claim 1 including means for selectively moving said upper framework from the transport position to said raised position.

3. Vehicle repair apparatus including a lower framework forming a cage for receiving a damaged vehicle, said lower framework including upwardly extending members disposed outwardly from said vehicle on opposite sides thereof, means for restraining said damaged vehicle within said lower framework, and means attached to said lower framework for applying a force on a portion of said damaged vehicle, the improvement comprising:

an upper framework including downwardly extending members disposed outwardly from said vehicle on opposite sides thereof and being disposed to contact said upwardly extending members, and being connected together by horizontally extending beam means, said upper framework being movably attached to said lower framework; and means for permitting said upper framework to be selectively movable with respect to said lower framework between a lowered transport position and a raised working position.

4. The vehicle repair apparatus of claim 3 further including:

means attached to said upper framework for applying a force on a portion of said damaged vehicle.

5. The vehicle repair apparatus of claim 3 including means for selectively moving said upper framework from the transport position to said raised position.

* * * * *